US011375742B2

(12) United States Patent
Mishra et al.

(10) Patent No.: US 11,375,742 B2
(45) **Date of Patent: *Jul. 5, 2022**

(54) SMOKING ARTICLE WITH REDUCED TOBACCO

(71) Applicant: Altria Client Services LLC, Richmond, VA (US)

(72) Inventors: Munmaya K. Mishra, Manakin Sabot, VA (US); Shaoyong Yu, Glen Allen, VA (US); Bernard S. Appleton, Chesterfield, VA (US); Weiling Li, Moseley, VA (US)

(73) Assignee: Altria Client Services LLC, Richmond, VA (US)

( * ) Notice: Subject to any disclaimer, the term of this patent is extended or adjusted under 35 U.S.C. 154(b) by 139 days.

This patent is subject to a terminal disclaimer.

(21) Appl. No.: 16/984,966

(22) Filed: Aug. 4, 2020

(65) Prior Publication Data

US 2020/0359674 A1 Nov. 19, 2020

Related U.S. Application Data

(63) Continuation of application No. 15/704,629, filed on Sep. 14, 2017, now Pat. No. 10,765,143.

(51) Int. Cl.

| | |
|---|---|
| ***A24B 13/00*** | (2006.01) |
| ***A24B 15/40*** | (2006.01) |
| ***A24B 15/28*** | (2006.01) |
| ***A24D 3/06*** | (2006.01) |
| ***A24B 15/16*** | (2020.01) |

(52) U.S. Cl.
CPC ..... *A24B 15/403* (2013.01); *A24B 13/00* (2013.01); *A24B 15/16* (2013.01); *A24B 15/283* (2013.01); *A24D 3/061* (2013.01)

(58) Field of Classification Search
CPC ..... A24B 15/16; A24D 1/18
See application file for complete search history.

(56) References Cited

U.S. PATENT DOCUMENTS

| | | | |
|---|---|---|---|
| 3,545,448 | A | 12/1970 | Troon et al. |
| 3,556,109 | A | 1/1971 | Briskin et al. |
| 3,556,110 | A | 1/1971 | Briskin et al. |
| 3,638,660 | A | 2/1972 | Davis |
| 3,800,808 | A | 2/1974 | Reynolds |
| 3,807,414 | A | 4/1974 | Hedge |
| 3,861,401 | A | 1/1975 | Briskin et al. |
| 3,878,850 | A | 4/1975 | Gibson et al. |
| 3,902,504 | A | 9/1975 | Owens, Jr. et al. |
| 3,931,824 | A | 1/1976 | Miano et al. |
| 3,943,940 | A | 3/1976 | Minami |
| 3,943,941 | A | 3/1976 | Boyd et al. |
| 3,951,155 | A | 4/1976 | Prouse et al. |

(Continued)

*Primary Examiner* — Eric Yaary
(74) *Attorney, Agent, or Firm* — Harness, Dickey & Pierce, P.L.C.

(57) ABSTRACT

An exemplary smoking article including a smoking rod filled with a combination including tobacco filler material and cellulose filler material. The tobacco filler material and cellulose filler material can be arranged such that the constituent material particles are generally distributed throughout the smoking rod, the tobacco filler material at least partially surrounds the cellulose filler material along a length of the smoking rod, and/or the cellulose filler material particles have a higher concentration along a central axis of the smoking rod than the tobacco filler material particles.

57 Claims, 7 Drawing Sheets

(56) References Cited

U.S. PATENT DOCUMENTS

| | | | |
|---|---|---|---|
| 3,987,791 | A | 10/1976 | Chittenden et al. |
| 3,993,082 | A | 11/1976 | Martin et al. |
| 4,014,349 | A | 3/1977 | Morman et al. |
| 4,019,521 | A | 4/1977 | Briskin |
| 4,044,777 | A | 8/1977 | Boyd et al. |
| 4,079,742 | A | 3/1978 | Rainer et al. |
| 4,119,104 | A | 10/1978 | Roth |
| 4,296,762 | A | 10/1981 | Eicher et al. |
| 4,333,484 | A | 6/1982 | Keritsis |
| 4,506,684 | A | 3/1985 | Keritsis |
| 4,942,888 | A | 7/1990 | Montoya et al. |
| 5,046,514 | A | 9/1991 | Bolt |
| 5,322,075 | A | 6/1994 | Deevi et al. |
| 5,497,792 | A | 3/1996 | Prasad et al. |
| 5,591,368 | A | 1/1997 | Fleischhauer et al. |
| 5,934,289 | A | 8/1999 | Watkins et al. |
| 5,996,589 | A | 12/1999 | St. Charles |
| 6,041,789 | A | 3/2000 | Bankert et al. |
| 6,053,176 | A | 4/2000 | Adams et al. |
| 6,083,176 | A | 7/2000 | Terwilliger |
| 6,257,243 | B1 | 7/2001 | Muller et al. |
| 7,428,905 | B2 | 9/2008 | Mua |
| 7,578,298 | B2 | 8/2009 | Karles et al. |
| 7,836,896 | B2 | 11/2010 | Nadimi et al. |
| 8,235,056 | B2 | 8/2012 | Zhuang et al. |
| 8,240,315 | B2 | 8/2012 | Olegario et al. |
| 8,282,739 | B2 | 10/2012 | Mishra et al. |
| 8,573,230 | B2 | 11/2013 | Zhuang et al. |
| 8,671,951 | B2 | 3/2014 | Ercelebi et al. |
| 8,905,037 | B2 | 12/2014 | Lipowicz et al. |
| 9,066,541 | B2 | 6/2015 | Allen et al. |
| 9,185,935 | B2 | 11/2015 | Lewis et al. |
| 9,370,160 | B2 | 6/2016 | Xu et al. |
| 2004/0231684 | A1 | 11/2004 | Zawadzki et al. |
| 2005/0263161 | A1 | 12/2005 | Mua |
| 2008/0168998 | A1 | 7/2008 | Badertscher |
| 2009/0014020 | A1 | 1/2009 | Yoss et al. |
| 2011/0048434 | A1 | 3/2011 | Chen et al. |
| 2011/0120481 | A1 | 5/2011 | Besso et al. |
| 2011/0259352 | A1 | 10/2011 | Woodcock et al. |
| 2013/0284189 | A1 | 10/2013 | Dittrich et al. |
| 2014/0102465 | A1 | 4/2014 | Snow et al. |
| 2014/0202478 | A1 | 7/2014 | Awty et al. |
| 2015/0090232 | A1 | 4/2015 | DePatie |
| 2015/0090292 | A1 | 4/2015 | DePatie |
| 2016/0205996 | A1 | 7/2016 | John et al. |
| 2016/0374387 | A1 | 12/2016 | Adams et al. |

SMOKING ARTICLE WITH REDUCED TOBACCO

CROSS REFERENCE TO RELATED APPLICATIONS

This application is a continuation patent application of U.S. patent application Ser. No. 15/704,629, filed Sep. 14, 2017, the entire content of which is incorporated herein by reference.

FIELD

The present disclosure is related to a smoking article, and particularly a smoking article having a filler composed of tobacco and a non-tobacco smokeable material.

SUMMARY

An exemplary smoking article is disclosed, comprising: a smoking rod filled with a combination of materials including tobacco filler material and cellulose filler material, wherein the tobacco filler material at least partially surrounds the cellulose filler material along a length of the smoking rod.

An exemplary smoking article is disclosed, comprising: a smoking rod filled with filler material including tobacco filler material and cellulose filler material, wherein the cellulose filler material is arranged in a higher temperature burn area of the smoking rod in relation to the tobacco filler material.

An exemplary smoking article is disclosed, comprising: a filter portion; and a smoking rod including a blend of tobacco filler material and cellulose filler material, the blend containing a higher concentration of cellulose filler material than tobacco filler material in a central area along a length of the smoking rod.

An exemplary smoking article is disclosed, comprising: a smoking rod including a filler comprising a mixture including tobacco filler material and cellulose filler material, wherein the tobacco filler material and cellulose filler material are distributed throughout the mixture along a length of the smoking rod.

An exemplary smoking article is disclosed, comprising: a smoking rod including a filler comprising a mixture including modified tobacco filler material and cellulose filler material, wherein the modified tobacco filler material and cellulose filler material are distributed throughout the mixture along a length of the smoking rod.

An exemplary smoking article is disclosed, comprising: a smoking rod including a filler comprising a mixture of a tobacco filler material and second filler material, wherein the first and second tobacco filler materials are distributed throughout the mixture along a length of the smoking rod, and the second filler material has a lower nicotine content or lower nicotine delivery, or both, than the tobacco filler material.

Certain embodiments may release less smoke from tobacco during combustion, and therefore a lower amount of chemicals included in smoke from tobacco, compared to a smoking article with a smoking rod that only includes tobacco.

BRIEF DESCRIPTION OF THE DRAWING FIGURES

Various aspects are further described in the detailed description which follows, in reference to the noted plurality of drawings by way of nonlimiting examples of embodiments, in which like reference numerals represent the same or similar components.

FIG. 1*a* illustrates a first smoking article in accordance with an exemplary embodiment of the present disclosure;

FIG. 1*b* illustrates a second smoking article in accordance with an exemplary embodiment of the present disclosure;

FIG. 1*c* illustrates an exploded view of the second smoking article in accordance with an exemplary embodiment of the present disclosure;

FIGS. 2*a*-2*c* illustrate various blended states of the smoking material in accordance with exemplary embodiments of the present disclosure;

FIGS. 3*a*-3*c* illustrate an interface filled with an additive in accordance with exemplary embodiments of the present disclosure;

Figure 8A:
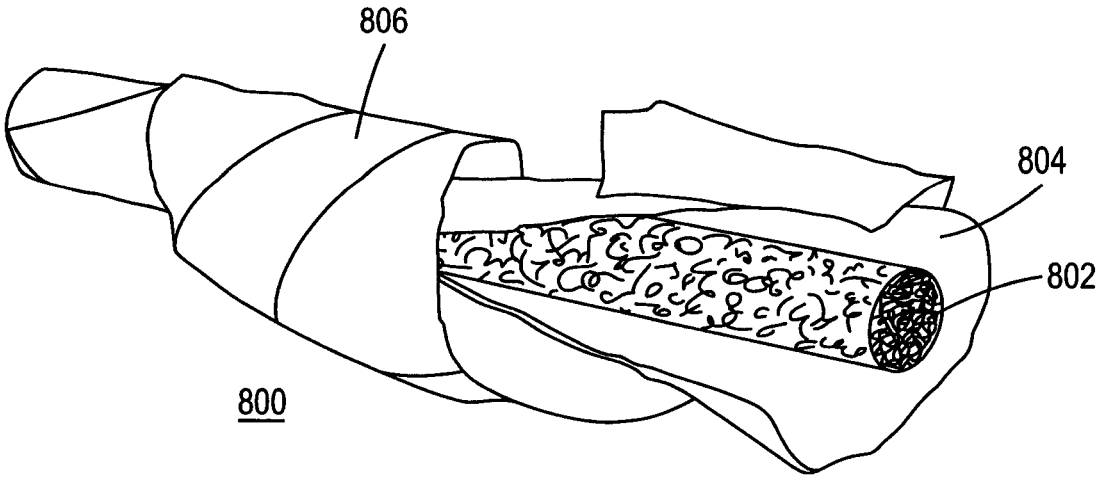
Figure 8B:
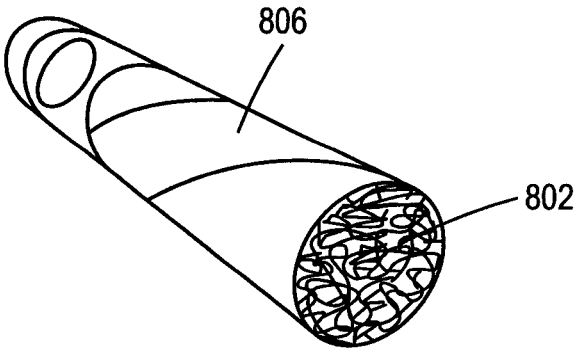
Figure 9A:
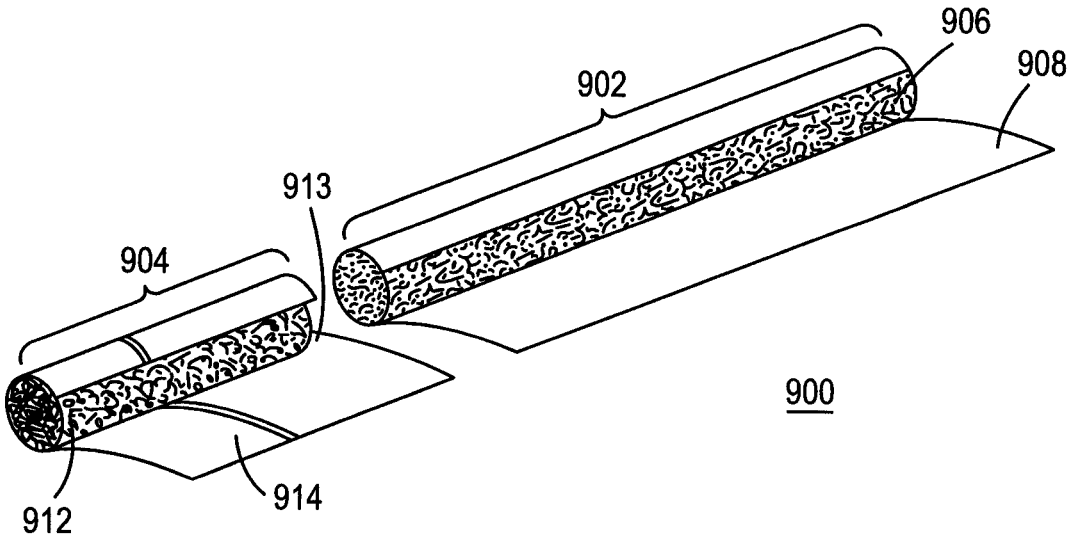
Figure 9B:
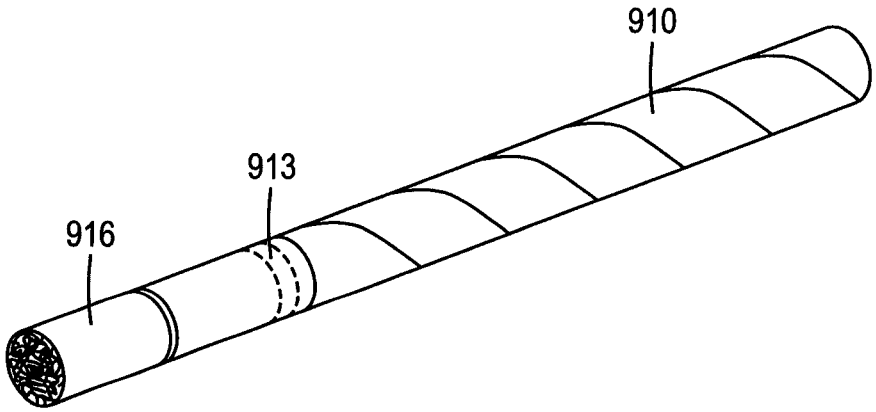

FIGS. 8*a* and 8*b* illustrate a smoking article formed as a cigar in accordance with exemplary embodiments of the present disclosure; and FIGS. 9*a* and 9*b* illustrate a smoking articled formed as a cigarillo in accordance with exemplary embodiments of the present disclosure.

DETAILED DESCRIPTION

Reference will now be made in detail to various embodiments, one or more examples of which are illustrated in each figure. Each example is provided by way of explanation and is not meant as a limitation. For example, features and/or method steps illustrated or described as part of one embodiment and/or method can be used on or in conjunction with other exemplary embodiments and/or method steps to yield yet further exemplary embodiments or methods. It is intended that the present disclosure includes such modifications and variations.

Exemplary embodiments of the present disclosure are directed to a smoking article having smoking material formed from a mixture or blend including tobacco filler material and cellulose filler material. The smoking article can include an interface that may be formed from an unfilled portion of the smoking rod or the filter, that may be formed between a smoking rod and a filter, or that may be formed through other means. Additives such as tobacco derivatives or flavorants can be provided in the filler material, the interface and/or the filter. For example, the interface can include one or more liquid filled capsules and/or fibrous material injected or infused with liquid additive(s) or other type of additives. The smoking article can also include a filter portion having a single- or multi-plug arrangement.

The term "mainstream smoke" includes the mixture of gases and/or aerosols passing through an exemplary smoking article of the present disclosure. For example, mainstream smoke may pass from a burn end through a smoking rod, and issue from a mouth end through a filter portion opposite the burn end when a filter portion is included. Mainstream smoke may also contain air that is drawn in.

The term "sidestream smoke" includes smoke that flows directly into the air from the burn end of the smoking article during smoking.

"Smoking" of an exemplary smoking article of the present disclosure is intended to include the heating (e.g., thermal heating), combusting and/or causing chemical reactions in the smoking material. Generally, the act of smoking a smoking article involves igniting the burn end of the smoking rod and drawing the mainstream smoke through the smoking rod and out of the mouth end of the smoking article. However, the smoking material may also be smoked by other means. For example, the smoking article may be smoked by heating the burn end of the smoking rod via an electrical heater, as described, for example, in commonly-assigned U.S. Pat. No. 6,053,176; 5,934,289; 5,591,368 or 5,322,075, each of which is incorporated herein by reference in its entirety.

The term "additive" includes any material or component which modifies the characteristics of the smoking material or the smoking article during smoking. Any appropriate additive material or combination of materials may be contained as an additive, within an additive insert, and/or inside one or more capsules, beads, or liquids to modify the characteristics of a smoking article of the present disclosure and may provide, for example, automatic or on-demand release of flavoring or other additives. Such additive materials can include flavors, neutralizing agents, and other smoke modifiers. Other examples may include, without limitation, chemical reagents like 3-aminopropylsilyl (APS) which interacts with smoke constituents. Additionally, additive materials may also include diluents, solvents or processing aids that may or may not impact the sensorial attributes of the mainstream smoke but aid in processing of an additive and its placement, encapsulation, and/or presentation in the smoking article. Additives may be provided in various forms, for example, such as liquid, beads, capsules, other solids or partially solid forms, a combination thereof, etc. As disclosed herein, additives may further include, for example and without limitation, aromas, flavorants, diluents, humectants, tobacco derivatives, or combinations thereof, and any material or component which modifies the characteristics of the smoking material or the smoking article during smoking.

According to an exemplary embodiment of the present disclosure, the additive materials may include one or more flavors, such as liquid or solid flavors and flavor formulations or flavor-containing materials. Flavor may also include any flavor compound or tobacco extract suitable for being releasably disposed in liquid or immobilized form within an insert, beads, and/or single- or multi-part macrocapsules or microcapsules. Certain flavor additives, for example, may modify the taste of mainstream smoke produced, for example, by the smoking article. In some embodiments, an additive containing insert, bead, or capsule may be at least partially combusted or ruptured along with the combustion of the smoking rod of a smoking article during smoking to release additives from the insert, bead, and/or capsule.

Suitable flavors or flavorings include, but are not limited to menthol, mint, such as peppermint and spearmint, chocolate, licorice, citrus and other fruit flavors, gamma octalactone, vanillin, ethyl vanillin, breath freshener flavors, spice flavors such as cinnamon, methyl salicylate, linalool, bergamot oil, geranium oil, lemon oil, ginger oil, tobacco flavor, and any other flavors. Suitable flavors may further include flavor compounds selected from the group consisting of an acid, an alcohol, an ester, an aldehyde, a ketone, a pyrazine, combinations or blends thereof and the like. Suitable flavor compounds may be further selected, for example, from the group consisting of phenylacetic acid, solanone, megastigmatrienone, 2-heptanone, benzylalcohol, cis-3-hexenyl acetate, valeric acid, valeric aldehyde, ester, terpene, sesquiterpene, nootkatone, maltol, damascenone, pyrazine, lactone, anethole, iso-valeric acid, etc., combinations thereof and the like.

By incorporating additive materials in certain embodiments, for example, in the filler material, in inserts, or one or more beads or capsules, loss of flavor due to less tobacco in the smoking rod (compared to a smoking rod that only includes tobacco) may be reduced. In certain embodiments, additive materials in flavor capsules may be releasably disposed on-demand such that the additive materials are sufficiently contained to substantially avoid or minimize unwanted migration to other areas of the smoking article, such as during storage. Moreover, additive materials provided in capsule form may be mobile enough to be released on-demand from the flavor capsule when, for example, the capsule is broken or opened by mechanical force. For example, the flavor capsule may be broken by squeezing a portion of a filter or interface containing the flavor capsule, thus releasing the additive material stored therein.

As already discussed, additives may be implemented in a variety of physical forms including inserts, liquids, small or large beads, singular part or multipart capsules, large capsules, small capsules, microcapsules, macrocapsules, etc. In certain embodiments, flavoring, tobacco derivatives and/or other additives may be present in the smoking material of the burn portion, the mouth portion, a filter and/or an interface between the filter and smoking rod. Additives may be provided in a dispersed or densely packed arrangement. Arrangements may also be based on any one or combination of the form or size of the additive packaging (e.g., small and/or large beads or capsules), the size of the space in which the additive will be disposed, and the amount of additive desired for release during smoking.

Beads and capsules, if used, may be formed by any suitable technique including encapsulation techniques, such as spin coating, coacervation, interfacial polymerization, solvent evaporation, annular jet forming, which uses two concentric jets to eject an inner jet of liquid core material and an outer jet of liquid wall material where the fluid stream breaks into droplets and the liquid wall material solidifies by phase transition induced by the presence of cross-linking ions, pH differences, temperature changes, or other conditions as desired.

The capsules or beads may be formed as single wall or multi-wall capsules, which can be used based on capsule stability, strength, rupture resistance, processing ease in filter making, or other factor as desired, and be made of any suitable material, such as a gelatin-based material, or a polymeric material, such as modified cellulose (e.g., hydroxypropylmethyl cellulose).

Figure 1A:
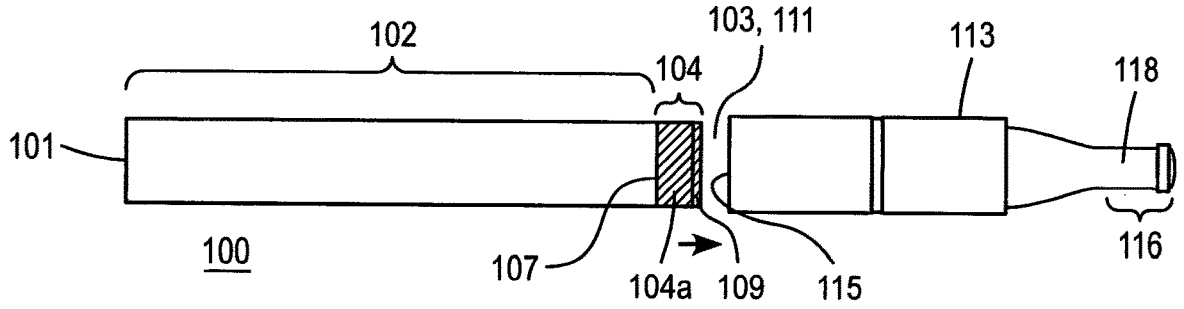
Figure 1B:
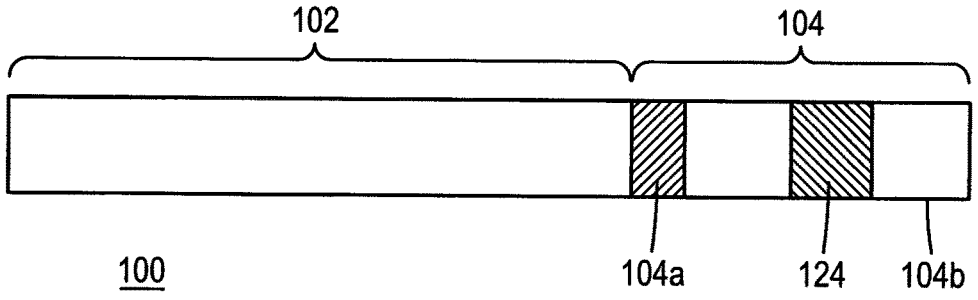
Figure 1C:
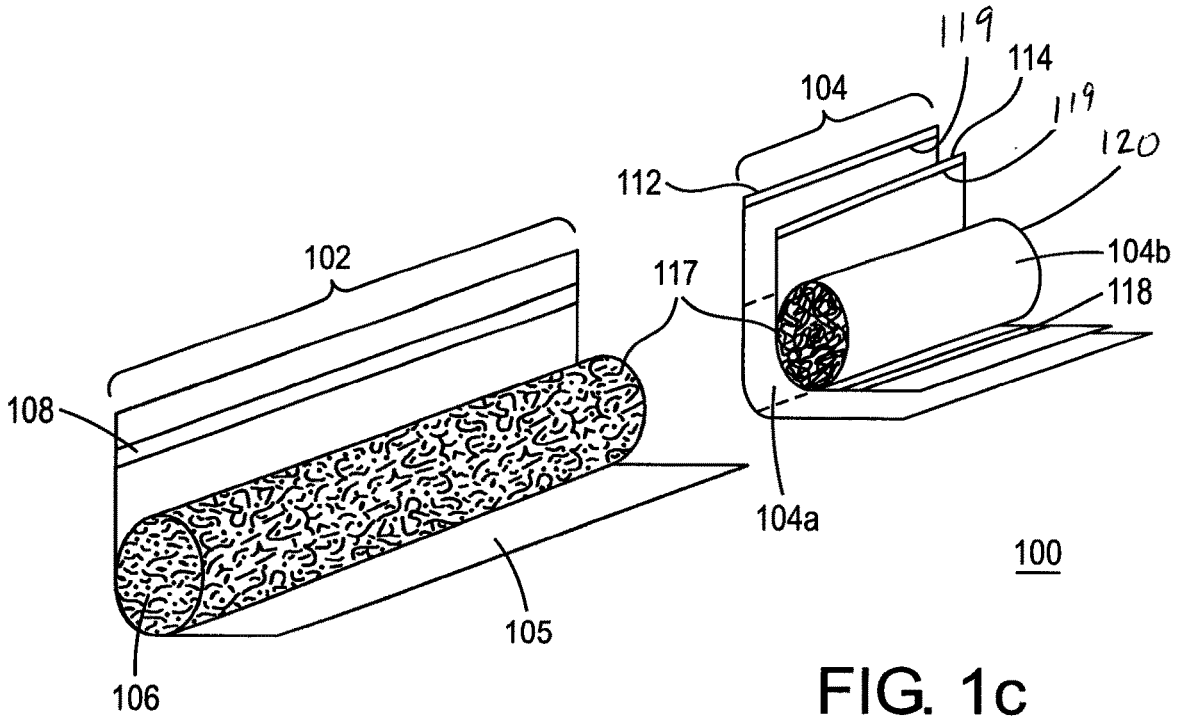

FIGS. 1*a*-1*c* illustrate smoking articles in accordance with an exemplary embodiment of the present disclosure. As shown in FIG. 1*a*, the smoking article 100 may be substantially in the shape of a cylinder (other shapes may also be used). The smoking article 100 may include two sections—a burn portion 102 (e.g., smoking rod) and a mouth portion 104. An exposed end of the burn portion 102 forms a burn end 101 and an exposed end of the mouth portion 104 forms a mouth end 103. The burn portion 102 includes a smoking rod filled with smoking material 106 (FIG. 1*c*) formed from a blend or combination of a biopolymer material such as cellulose, and tobacco material. Biopolymer materials other than cellulose materials may also be used. Cellulose materials may include cellulose filter paper, wood, jute, ramie, tree bark, banana leaves, bamboo, paper, cotton, or cotton-based material, or any other suitable cellulose material, cellulosic material, cellulosic-derived material, or any combination thereof as desired. In certain embodiments, the smoking material 106 may be prepared, in part, from any known cellulose filter papers of any grade. In certain embodiments, the smoking material 106 may be prepared, in part, from cellulose filter papers made of high quality cotton linters having a minimum alpha cellulose content of 98% and/or an ashless grade with a low ash content. For example, according to some embodiments, the ash content may be less than or equal to 0.5%, 0.1% (e.g., 0.005%), between 0.1% and 0.15%, or less than 0.04% (e.g., 0.005%, 0.007%, 0.01%). According to another exemplary embodiment, the smoking material 106 may include a cellulose material that is substantially acid-free and/or unbleached.

In certain embodiments, the tobacco material may be of a conventional type, which includes a naturally-allocated nicotine content, or the tobacco material may be of a modified type where the nicotine content or nicotine delivery is lower than found in conventional tobacco leaves. The modified tobacco material may be produced through known processes, which include but are not limited to nicotine extraction and tobacco plant alteration. Sample processes for extracting nicotine from tobacco leaves are described in U.S. Pat. No. 5,497,792, the content of which is hereby incorporated by reference in its entirety. Other example processes, including examples of alteration of tobacco are described in U.S. Pat. No. 9,370,160 and U.S. Patent Application Publication No. 20160374387, the entire content of each being hereby incorporated by reference. In yet another exemplary embodiment of the present disclosure, the smoking material 106 can include a mixture of conventional tobacco material and modified tobacco material. In certain embodiments, the smoking material 106 may be formed with a filler including a mixture of cellulose material and conventional or modified tobacco material or a mixture of conventional tobacco material and modified tobacco material, or combinations thereof. The smoking material 106 used in the smoking rod may take many forms, including without limitation a preformed rigid rod, shredded (or cut) fibers, woven strands, filament, or any other suitable forms as desired. Prior to placement in the smoking rod, the blended smoking material 106 may include filter paper that is cut or shredded into a form similar in appearance to shredded tobacco and combined with shredded or cut tobacco.

As shown in FIG. 1*a*, in certain embodiments the mouth portion 104 can include an interface 104*a*. The interface 104*a* may be formed as a hollow or empty volume that may include an unfilled portion of the smoking rod 102. The interface 104*a* may be configured or arranged to store an additive. The interface 104*a* may also store tobacco cut filler material, tobacco cut filler material impregnated with an additive or in combination with an additive. According to another exemplary embodiment, the interface 104*a* may be additive-free. In certain embodiments, the interface 104*a* is empty.

In some embodiments, the interface 104*a* can be of a length suitable for storing a desired amount of additive. For example, according to an exemplary embodiment, the interface 104*a* has a length greater than 0 mm to approximately 3 mm. Greater lengths may be used in other embodiments. The interface 104*a* may be established opposite the burn end 101 of the burn portion 102 for example through one or a combination of an unfilled portion of the burn portion 102 and an empty volume established through the portion of the wrapping paper that overlaps or extends past the opposite end 107 of the burn portion 102.

In some embodiments, a small amount (e.g., in a range of 3-5 mm by volume) of material such as cellulose acetate, polypropylene, or paper, may be used as a cap or plug 109 on the open end 111, which corresponds to the mouth end 103, of the interface 104*a* after the additive has been disposed. Material that may be disposed in the interface 104*a* may also be used to adjust a draw resistance of the smoking article as desired. A smoking tip 113 can be used in certain embodiments during smoking of the smoking article 100. For example, the end 111 of the interface 104*a* can be inserted into an open end 115 of the smoking tip 113, the open end 115 of the smoking tip 113 having a diameter suitable for receiving the smoking article. Inserting the smoking article 100 into the open end 115 of the smoking tip 113 may require a small force (e.g., minimum amount of force necessary to urge the mouth end 103 of the smoking article into the open end 115 of the smoking tip 113) in the direction (e.g., see arrow) of the open end 115 and/or rotation of the smoking article 100.

According to another exemplary embodiment, the smoking tip 113 can be formed from any known material such as wood, plastic, composites, or any other suitable material for oral use. The smoking tip 113 can be formed using an injection molding manufacturing process. The smoking tip 113 can also have an orthonasal property whereby an additive such as flavor and/or aroma can be discharged from a surface 118 of the smoking tip 113. For example, the orthonasal property can have a mouth end 116. The orthonasal property can be formed on the surface 118 in an area of the mouth end 116 as a ring, segment, patch, line or other suitable feature as desired. The orthonasal property can be integrated into the surface of the smoking tip 113 during the injection molding process or added to the surface 118 post manufacturing by known processes (e.g., patch, spray, baking, curing, etc.). The additive may include at least one of an aroma and flavor compound corresponding to (e.g., substantially the same as, substantially similar to, or complementary to) and/or simulating the aroma of the additive flavor disposed in the burn portion 102 and/or mouth portion 104 of the smoking article.

FIG. 1*b* illustrates a second smoking article in accordance with an exemplary embodiment of the present disclosure. The smoking article 100 of FIG. 1*b* includes a burn portion 102 and a mouth portion 104. The mouth portion 104 includes an interface 104*a* and a filter plug 104*b* formed of cellulose acetate fiber or any other suitable filtering material as desired.

FIG. 1*c* illustrates an exploded view of a smoking article in accordance with an exemplary embodiment of the present disclosure. As shown in FIG. 1*c*, the mouth portion 104 may include the filter plug 104*b* that can be wrapped (e.g., covered) with tipping paper 112. A layer of plug wrap 114 can be applied on the filter plug 104*b* adjacent an inner side of the tipping paper 112. The tipping paper 112 may extend past an edge of the filter plug 104*b* and overlap the mouth portion 104 and the smoking rod 102 so that the two sections are held together. Tipping paper 112 may be of such length that an interface 104*a* of the mouth portion 104 may be established via an empty volume between the adjacent ends 117 of the burn portion 102 and the filter plug 104*b*.

Extending the wrapping material 105 that wraps the smoking rod would create a similar overlapping arrangement and interface in other embodiments. In certain embodiments, interface 104*a* may be configured to store additives or other materials, as described above for FIG. 1*a*. In other embodiments, interface 104*a* may be empty as also described above. In yet other embodiments there may be no interface 104*a* or space between ends 117 of the burn portion 102 and the filter plug 104*b* such that the ends of each are adjacent to each other. Because the end 120 of the filter plug 104*b* forms the mouth end 103 of the smoking article 100, the cap or plug 109 is not needed for the interface 104*a*. Both the tipping paper 112 and the plug wrap 114 can have adhesive seams 119 for holding the seams of the tipping paper 112 and the plug wrap 114 together. Additional adhesive seams or lines may be included for the tipping paper 112 or the plug wrap 114. For example, the plug wrap 114 may also include an inner adhesive line 118 for adhering to the filter plug 110.

The mouth portion 104 of the smoking article 100 may include any of the variety of fibrous material suitable for use as filter elements in a tobacco cigarette. The fibrous material can include cellulose acetate, polypropylene, paper, or any other suitable material as desired. The same types of fibrous materials may also be used in combination with tobacco or modified tobacco as part of the smoking rod mixture. The mouth portion 104 can include one or more fibrous material plugs. In a configuration having two or more plugs, a void or hollow space can be formed between adjacent plugs.

Figure 2A:
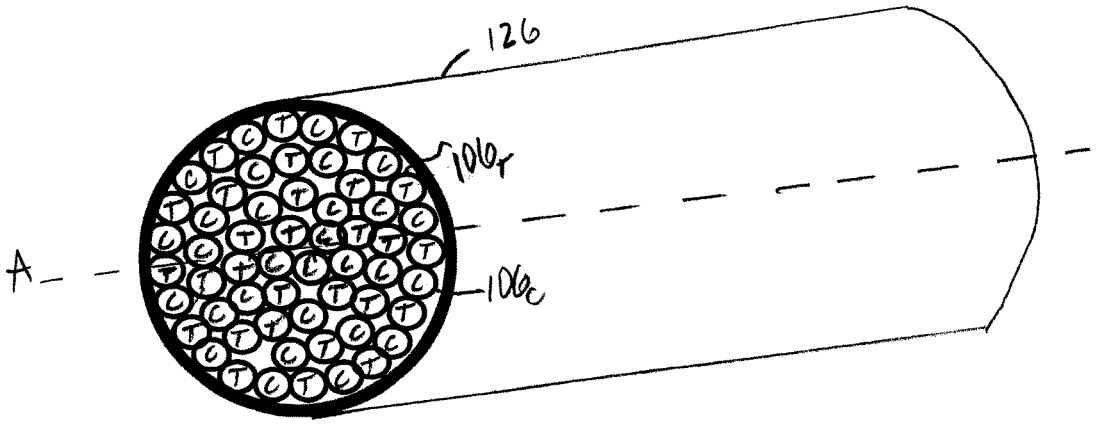
Figure 2B:
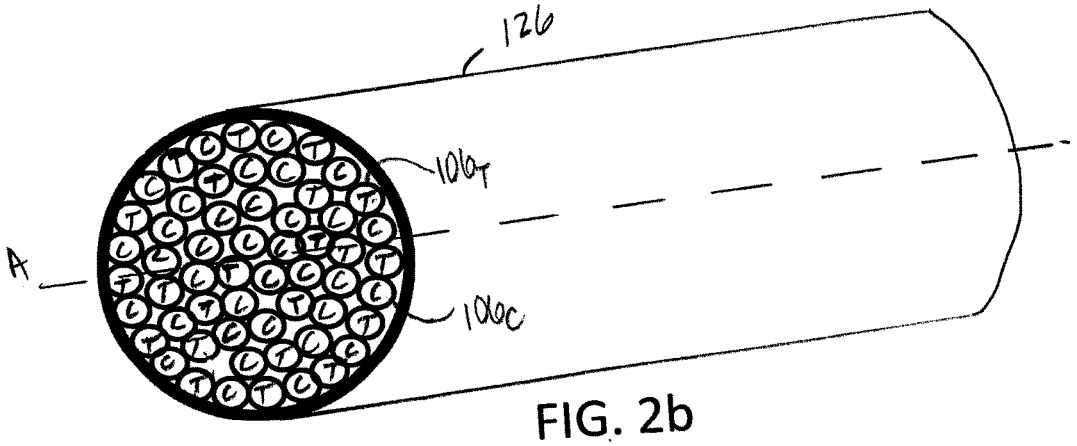
Figure 2C:
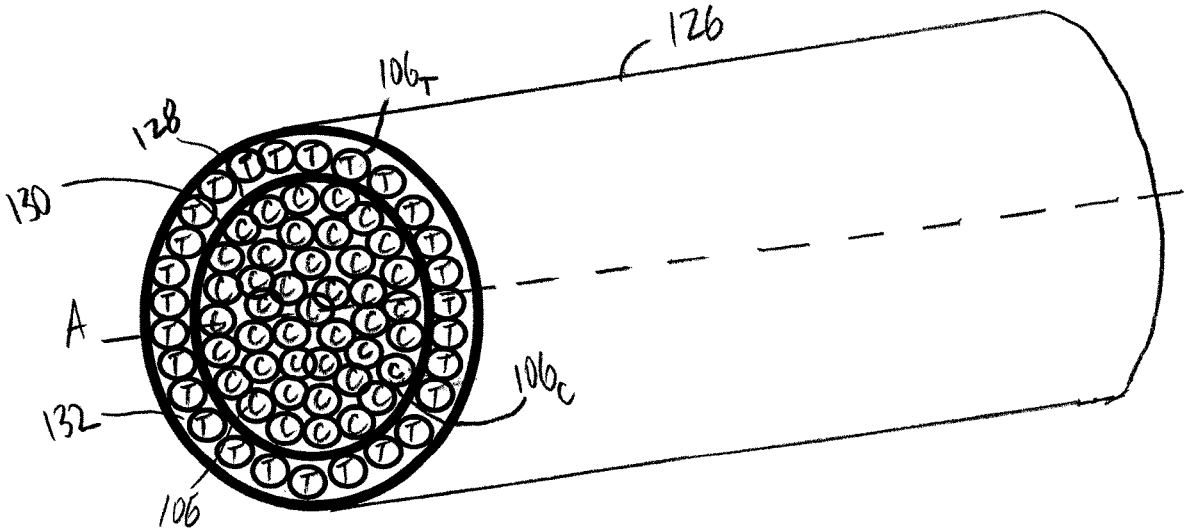

The conventional tobacco filler material may be combined or blended with cellulose filler material or modified tobacco filler material in a variety of ways. In accordance with exemplary embodiments of the present disclosure, the ratio of tobacco filler material to cellulose filler material or modified tobacco filler material may be, for example and without limitation, in a range of approximately 95:5 to 25:75, including, for example, in a ratio of approximately 50:50. Other ranges may be used. FIGS. 2*a*-2*c* illustrate various blended states of the smoking material in accordance with an exemplary embodiment of the present disclosure. In the following examples, it should be understood that the tobacco filler particles can be formed of conventional or modified tobacco filler material or a mixture of the two. As shown in FIG. 2*a*, for example, the smoking material 106 may be mixed such that the tobacco filler particles 106T and the cellulose filler particles 106*c* are evenly or randomly distributed throughout the material. As shown in FIG. 2*b*, the smoking material 106 may be blended such that the cellulose filler particles 106*c* have a higher concentration along or surrounding a central axis A of the smoking rod 102 than do the tobacco filler particles 106T. FIG. 2*c* illustrates another exemplary blend of the smoking material 106 in which an area of the tobacco filler particles 106T fully surround an area of the cellulose filler particles 106*c* along a length of the smoking rod 102. In some embodiments, tobacco filler particles 106T may only partially surround an area of cellulose filler particles 106*c* (e.g., may surround an area of the cellulose filler particles only to some extent) such that some of the tobacco filler particles 106T and some of the cellulose filler particles 106*c* may be inter-mixed. These embodiments would include, for example and without limitation, the embodiment shown in FIG. 2*b*, as well as other embodiments where tobacco filler particles 106T may only partially surround an area of cellulose filler particles 106*c*. The tobacco filler particles 106T and the cellulose filler particles 106*c* can also be separately disposed in concentric areas along the length of the smoking rod. For example, the tobacco filler particles 106T may be formed as a cylindrical rod 126 having a hollow core 128. Shredded or cut cellulose filler particles 106*c* may be disposed within the hollow core 128 of the cylindrical rod 126. According to another exemplary embodiment, the cellulose filler material may be a cylindrical rod having a diameter smaller than a diameter of the hollow core of the cylindrical rod of the tobacco filler material. It should be understood that for each of the aforementioned embodiments the cellulose filler material can be substituted with modified tobacco filler material or a mixture of cellulose filler material and modified tobacco filler material.

Certain embodiments having an arrangement in which the cellulose filler particles 106*c* are arranged around the central axis A of the smoking rod 102 or the cellulose filler particles 106*c* have a higher concentration along the central axis A of the smoking rod 102 may provide several advantages. During the combustion process, the smoking material 106 in the smoking rod 102 can be exposed to temperature in the range of 300° to 900° C. Different portions of the smoking rod 102 can have different ranges of burn temperature. For example, a center portion 130 of the smoking rod 102 adjacent or overlapping the central axis A may be exposed to burn temperatures in the range of approximately 500° to 900° C. Periphery portions 132 of the smoking rod 102 may be exposed to burn temperatures in the range of approximately 300° to 500° C.

Various filter constructions known in tobacco cigarettes similarly can be used in connection with the exemplary smoking articles of the present disclosure, including those in which one or more flavor capsules may be incorporated. According to another exemplary embodiment, the filter constructions may be additive-free based on a location and/or amount of additives present in another portion or area of the smoking article. Exemplary filter structures can include, but are not limited to, a mono filter, a dual filter, a triple filter, a single or multi cavity filter, a recessed filter, a free-flow filter, combinations thereof, or any other suitable filter structure or configuration as desired. Mono (e.g., single) filters can include cellulose acetate tow or cellulose paper materials. Dual filters can include a cellulose acetate mouth end and a pure cellulose or cellulose acetate segment. The length and pressure drop of the segments in a dual filter may be adjusted to maintain acceptable draw resistance. Triple filters may include mouth side and non-tobacco smoking material as side segments, and a middle segment comprising paper. Cavity filters include at least two segments, e.g., acetate-acetate, acetate-paper or paper-paper, separated by at least one cavity. Recessed filters include an open cavity on the smoking end. The filters can also be disposed in a mechanically rotatable filter portion where flavor is released based on the pressure applied to the filter during rotation.

According to an exemplary embodiment of the present disclosure, the filter wrap 114 and/or tipping paper 112 can have an orthonasal property or characteristic 124 (FIG. 1*b*). For example, the tipping paper 112 may be processed with an additive so that a flavor and/or an aroma or scent emanates from the surface of the tipping paper 112. The tipping paper 112 and/or filter wrap 114 can include additives that discharge at least one of an aroma and flavor compound corresponding to (e.g., substantially the same as, substantially similar to, or complementary to) and/or simulating the aroma of the additive flavor disposed in the burn portion 102 and/or mouth portion 104 of the smoking article. The orthonasal property 124 (FIG. 1*b*) may be formed wholly or partially in the filter wrap 114 and/or tipping paper 112. According to an exemplary embodiment of the present disclosure, the orthonasal property 124 can be formed on the filter wrap 114 and/or tipping paper 112 as a ring, segment, patch, line, or other suitable feature as desired.

Figure 3A:
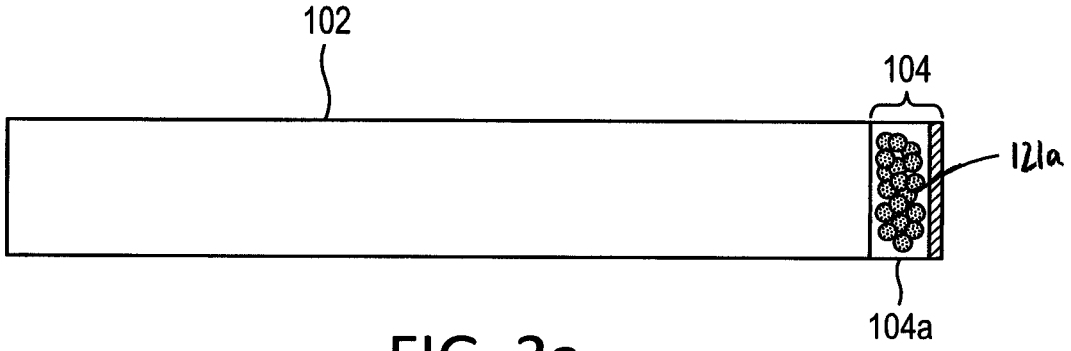
Figure 3B:
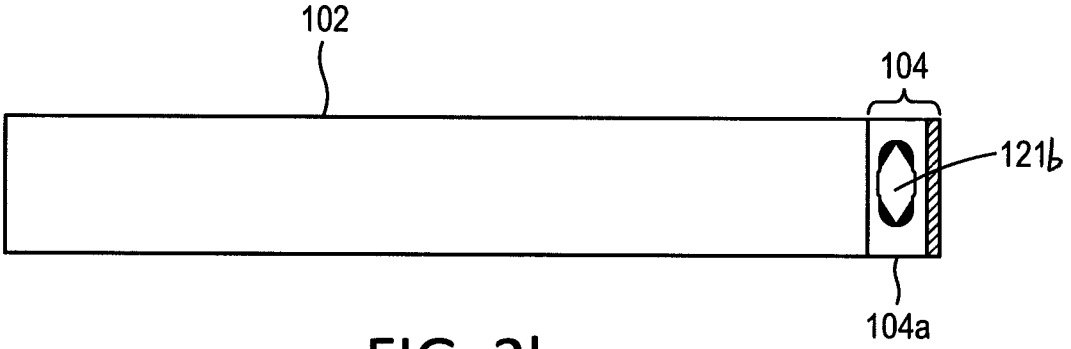
Figure 3C:
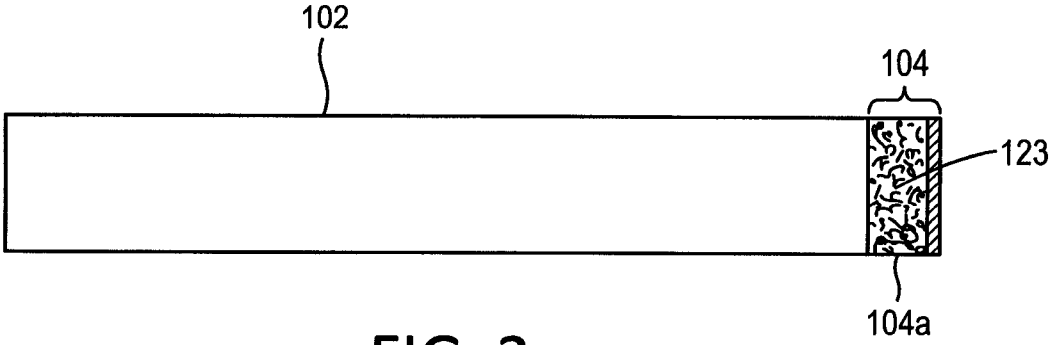

FIGS. 3*a*-3*c* illustrate an interface of a smoking article storing an additive in accordance with an exemplary embodiment of the present disclosure. FIG. 3*a* illustrates an interface 104*a* storing a plurality of flavor and/or other additive beads or capsules 121*a*. FIG. 3*b* shows an interface 104*a* storing a single bead or capsule 121*b*. FIG. 3*c* illustrates an interface 104*a* filled with material 123, such as tobacco filler material, cellulose acetate, polypropylene, or paper, or other suitable material as desired that is impregnated with a liquid additive. Interfaces 104*a* such as those shown in FIGS. 3*a* to 3*c* may be used in embodiments such as those in FIGS. 1*b* and 1*c*, as well as in embodiments such as those in in FIG. 1*a*.

The smoking material 106 can be processed to include additives including any combination of flavorants, or diluents including propylene glycol, glycerine, water, ethanol, tobacco derivatives, and any other additives as desired. According to an exemplary embodiment of the present disclosure, the smoking material 106 can be impregnated with any additives, such as, for example, flavors or tobacco derivatives. The smoking material can be encased or wrapped with known wrapping material used in tobacco cigarettes. For example, the wrapping material 105 can include paper having an adhesive 108 (FIG. 1*c*) for holding the seams of the wrapping material together.

According to another exemplary embodiment, the smoking material 106 can be used in an additive-free state. Additives, if used, can also be present in the interface 104*a* or a filter, for embodiments with a filter or interface. For example, in certain embodiments, the interface 104*a* may be filled at least partially with cellulose acetate, polypropylene, or paper material that is impregnated with a liquid additive.

Figure 4:
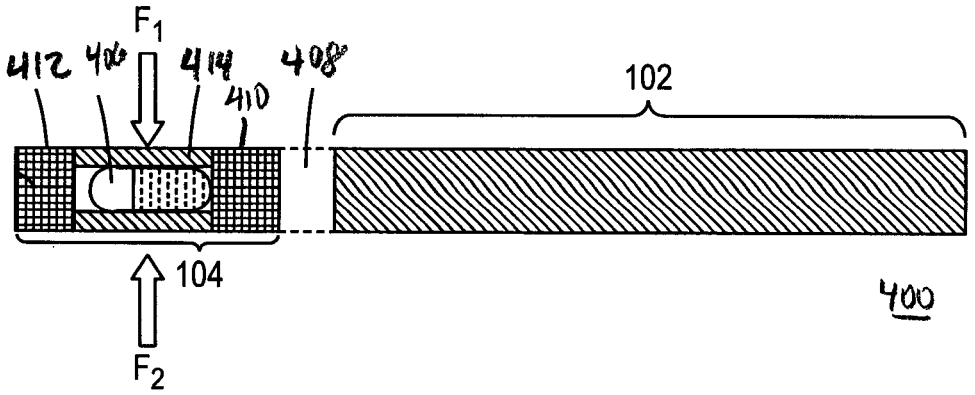
FIG. 4 illustrates a cross-sectional view of a smoking article having an interface and a flavor capsule in the filter portion in accordance with an exemplary embodiment of the present disclosure.

FIG. 4 illustrates a cross-sectional view of a smoking article having a capsule in the filter portion in accordance with an exemplary embodiment of the present disclosure. As shown in FIG. 4, the smoking article 400 includes a mouth portion 104 having a flavor capsule 406 including additive material, such as flavorant. The mouth portion 104 can be attached to the burn portion 102 where the mouth portion 104 may include a filter having a multi-plug design. For example, the mouth portion 104 may include along a length of the smoking article, an interface 408, which may store a liquid additive impregnated within or coated on material such as cellulose acetate, polypropylene, or paper. The interface 408 is adjacent the burn portion 102. Certain embodiments include filter plugs 410, 412. According to another exemplary embodiment, an additive in the form of a one or plural beads or capsules may be stored. The additive bead or capsule 406 can be located between the filter material regions 410, 412. The additive bead or capsule 406 can be frictionally fitted in a hollow acetate tube 414. An additive, such as an additive bead or capsule 406 can be located in interface 408.

For on-demand release of the additive, an area of the mouth portion 104 can be squeezed with forces $F_1$, $F_2$ on either side of the additive capsule 406. The applied forces cause at least partial rupture of the bead or capsule 406, thereby releasing the additive component to saturate or impregnate the filter plugs 410, 412. As the smoking article 400 is smoked, the additive released by the additive capsule 406 can be exposed to mainstream smoke passing through the mouth portion 104.

Figure 5:
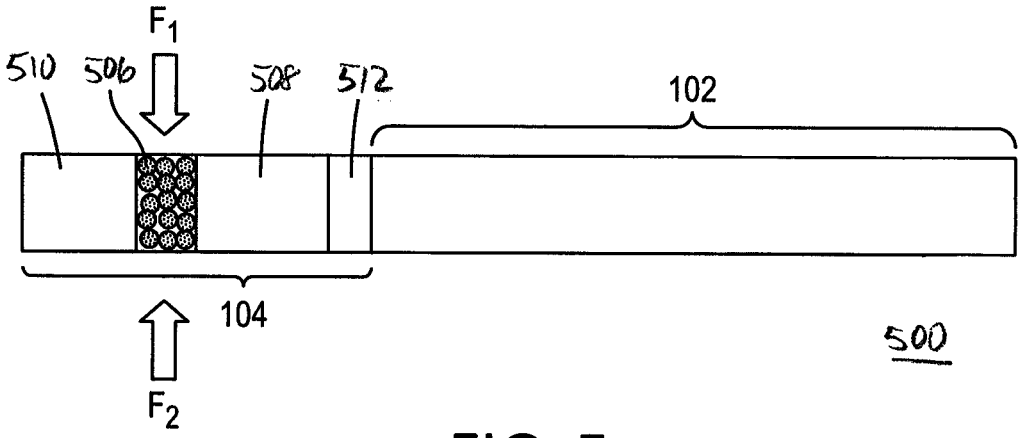
FIG. 5 illustrates a cross-sectional view of a smoking article having an interface and a plurality of flavor microcapsules in the filter portion in accordance with an exemplary embodiment of the present disclosure.

FIG. 5 illustrates a cross-sectional view of a smoking article having microcapsules in the filter portion in accordance with an exemplary embodiment of the present disclosure. As shown in FIG. 5, the smoking article 500 can include a burn portion 102 and mouth portion 104. The mouth portion 104 can have a multi-plug filter design that includes filter plugs 508 and 510 where filter plug 508 is adjacent the burn portion 102 and filter plug 510 is on the mouth end 103. The filter portion 104 can include flavor capsules 506 in the form of one or more microcapsules which encapsulate additive(s), such as flavorant. Each microcapsule 506 may be used alone or in combination with other microcapsules 506. When used in a smoking article 500, each microcapsule can contain the same or different additives from other microcapsule(s) in the smoking article 500, where applicable, depending upon the desired additive(s) or flavor. The smoking article 500 can also include an interface 512 for releasably storing a liquid additive impregnated in a material, such as cellulose acetate, polypropylene, or paper, or an additive provided in one or more beads or capsules. The additive provided in the interface 512 can be used in combination with or as a substitute for like additives provide in the smoking material 106 of the burn portion 102.

Figure 6:
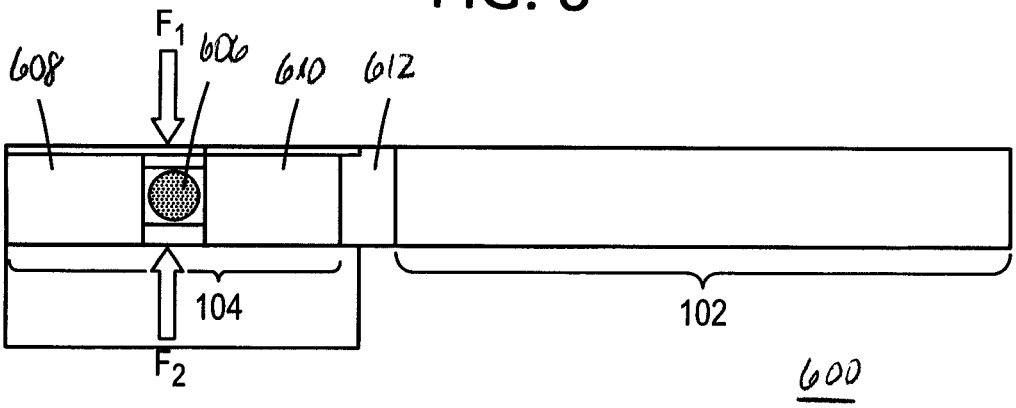
FIG. 6 illustrates a cross-sectional view of a smoking article having an interface and a flavor macrocapsule in the filter portion in accordance with an exemplary embodiment of the present disclosure.

FIG. 6 illustrates a cross-sectional view of a smoking article having one or more macrocapsules in the form of additive spheres 606 in the mouth portion in accordance with an exemplary embodiment of the present disclosure. As illustrated in FIG. 6, the macrocapsule 606 may be located in the filter 604 downstream from filter plug 610.

On-demand release of the additives from the microcapsules 506 of FIG. 5 or macrocapsules 606 of FIG. 6 can be achieved by squeezing with force on either (e.g., one or both) side(s) of the mouth portion 104 that contains the microcapsules 506 or macrocapsules 606, respectively. By applying the force ($F_1$, $F_2$), one or more of the microcapsules 506, 606 can be ruptured and the additive(s) contained therein would be released into the filter of the mouth portion 104 of the smoking article 500, 600. Thus, the additive(s) can be released within the mouth portion 104 after force is applied, providing on-demand delivery of flavorant.

As discussed in U.S. Pat. No. 7,578,298, the content of which is hereby incorporated by reference in its entirety, use of flavor capsules may provide advantages for supplying an additive component to the smoking article. Migration of the additive may be minimized in certain embodiments due to the use of a capsule which can retain the additive in a primary reservoir or within the microcapsules until use. The flavor capsules in certain embodiments provide a protective structure to prevent or minimize the migration of the additive component during storage into other parts of the smoking material. The location of the flavor capsules in the filter may also minimize loss of flavor to side stream smoke.

The additive which may be released from the additive capsules or beads upon squeezing or applying external force thereto may be supplied in any amount desirable for the particular type of additive used. The amount may be determined by the specific design of the additive capsules or beads, for example the first part of a two-part capsule may serve as the primary reservoir for the additive component, or the number and size of the microcapsules present in the filter. The amount of additive used per smoking article can be small since the additive is substantially sealed in the capsules during packaging and storing of the smoking article. An appropriate and/or desired amount of additive, e.g., such as flavor, can be released into the smoking article via the capsules. For example, when the capsules can release the additive in a small range, e.g., 3-6, 6-9, 9-12 microliters, or large range, e.g., 6-9, 9-12, or 12-15 or more microliters. In certain embodiments, the amount of additive released during smoking in the smoking article may be based on the number and/or size of capsules pre-loaded, a force applied to release the additive, and/or a number of sequentially applied forces.

Additive capsules may be of any size suitable for use in a smoking article. Additive capsules can have a diameter that is less than the diameter of the smoking article, e.g., less than 2 mm, 2 to 3 mm, 3 to 4 mm, 4 to 5 mm or greater than 5 mm, and can vary in length depending on the length of a filter in the mouth portion 104, e.g., less than 8 mm, 8-10 mm, 10-12 mm, or more than 12 mm. The additive capsule of FIG. 4 can be of sufficient size in certain embodiments, e.g., about 2 to 4 mm in diameter and about 8-11 mm in length, to allow for a desired amount of liquid additive component to be held within a multi-part capsule while the multi-part capsule also fits into the filter and provides a conveniently large target to apply force.

A two-part capsule can be placed in a hollow tube, by way of example, a hollow acetate tube, having an external diameter similar to that of a cigarette filter. In certain embodiments the placement of the capsule may be such that there is filter material at both ends of the hollow tube as shown in FIG. 4 or the hollow tube containing the capsule may be placed at a mouth end 103 of the mouth portion 104. Additionally, the orientation of the two-part capsule may be such that the portions of the capsule where force is applied are located within the axial circumference of a filter within the mouth portion 104, while the direction of the additive release may be oriented toward the mouth end of the mouth portion 104 or the burn portion 102 end of the mouth portion 104. It is noted that the orientation allows for access to applying force to the portions of the capsule designed to release additives upon the application of force.

In order to provide one or more microcapsules and/or macrocapsules in a mouth portion 104 of the smoking article in accordance with an exemplary embodiment described herein, the microcapsules can be the same or different sizes. For example, microcapsules can be made with rounded shapes having diameters smaller than 0.3 mm, from 0.3 to 1.0 mm, or even bigger diameters. According to an exemplary embodiment the microcapsules can be provided with diameters of about 0.3 to 0.4 mm. According to another exemplary embodiment of the present disclosure, the microcapsules can be provided in the form of round capsules with diameters of about 0.3 to about 0.4 mm. In accordance with an exemplary embodiment of the present disclosure, macrocapsules can have rounded shapes, such as round, seamless singular part with diameters of 1.0 to 6.0 mm. Diameters may also be smaller or larger. According to another exemplary embodiment, the macrocapsules can have a diameter from 3.0 to 4.0 mm. Round microcapsules and macrocapsules with these size ranges may allow for the effect on the resistance to draw by the microcapsules and/or macrocapsules to be minimal and may be compensated for in certain embodiments by a smoking article having a loosely packed or reduced packing tightness of smoking material in the burn portion 102 or the filter components (e.g., filter plugs) of the mouth portion 104.

Microcapsules having a diameter of about 0.35 mm packed in a hollow tube with a diameter of about 8 mm may allow in some embodiments the hollow tube to achieve about 90% fill without a substantial change in the resistance to draw. It is also noted that microcapsules smaller than 0.3 mm diameter capsules may be used. In certain embodiments, smaller microcapsules may be dispersed in filter tow material in the filter, rather than in a cavity, as the smaller size may lead to tighter packing and may lead to an increase in the resistance to draw if packed in a hollow tube portion of a filter. Larger microcapsules may also be dispersed in a filter tow material rather than in a cavity.

As illustrated in FIG. 5, microcapsules 506 (or macrocapsule 606 in FIG. 6) can be provided through a portion of the depth, width and length of mouth portion 104. The microcapsules 506, similar to the placement for the two-part capsule, can then be placed in a hollow tube such as a hollow acetate tube establishing an external diameter of the filter portion 104.

Figure 7:
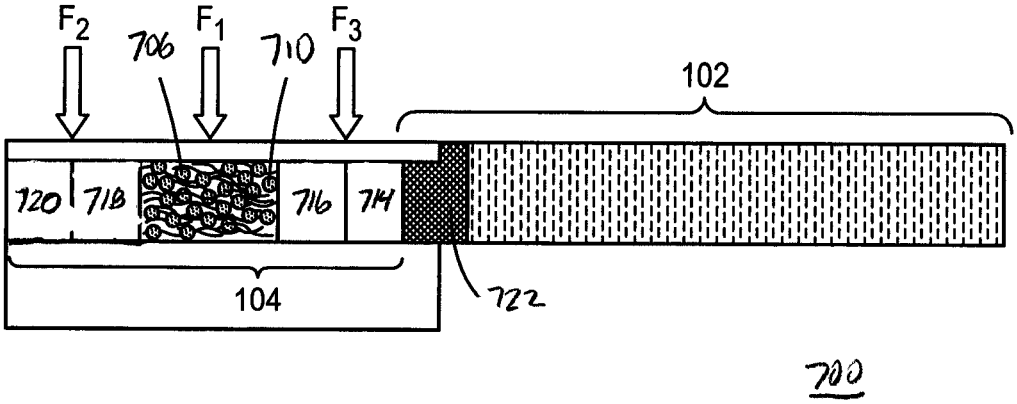
FIG. 7 illustrates a cross-sectional view of a smoking article having an interface and flavor microcapsules embedded in filter material in the filter portion in accordance with an exemplary embodiment of the present disclosure.

FIG. 7 illustrates a cross-sectional view of a smoking article having beads embedded in filter material in the filter portion in accordance with an exemplary embodiment of the present disclosure. In accordance with yet another exemplary embodiment of the present disclosure, microcapsules 706 can also be within a filter plug 710 of the mouth portion 104. The filter plug 710 can be sandwiched between one or more filter plugs on each side, such as filter plugs 714, 716 on a burn portion 102 end of the mouth portion 104 and filter plugs 718, 720 on a mouth end 103 of the mouth portion 104. The smoking article 700 can also include an interface 722 storing a liquid additive along with cellulose acetate tow. The additive or additives in the interface 722, may be used a substitute or in combination with additives that may be provided in the smoking material provided of the burn portion 102 and/or with additives that may be provided in an interface between the burn portion and the filter. In certain embodiments, additives may be released automatically during the smoking. In some embodiments, forces ($F_1$, $F_2$, $F_3$) may be applied along the length of the hollow acetate tube 712 of the filter portion 104 for on-demand release of the flavor additive into the smoking article 700. For example, if a force is applied in the area of $F_1$, the additives may be released proportional to the applied force in the directions of filter plugs 714, 716 and 718, 720. If, a force is applied in the area of $F_2$, the additives may be released in a direction toward filter plugs 714, 716. If a force is applied in the area of $F_3$, the additive may be released in a direction toward filter plugs 718, 720. Thus, according to an exemplary embodiment of the present disclosure, on-demand release, direction and/or amount of a flavoring in filter plug 710 may be controlled at least to some extent based on the location or area along the mouth portion 104 at which a force ($F_1$, $F_2$, $F_3$) is applied.

According to an exemplary embodiment of the present disclosure, the smoking article can include a deodorant that is releasably stored as an additive in the filter portion 104. In certain embodiments the deodorant can be releasably stored in a crushable bead or capsule of a hollow tube as described in accordance with FIGS. 4-7. The deodorant can be in liquid or powder form and include a base or acidic material, or a combination thereof (e.g., baking soda), which when released can disintegrate and modify odors and/or aromas. In certain embodiments, deodorants may also be released automatically during smoking, or on-demand by applying a force F to the capsule or bead as shown in FIGS. 4-7. In certain embodiments, when a deodorant is present in the mouth portion 104, flavor and/or other additives could be releasably stored in different locations, such as for example, the interface and/or the burn portions.

FIGS. 8*a* and 8*b* illustrate a smoking article formed as a cigar in accordance with an exemplary embodiment of the present disclosure. As shown in FIGS. 8*a* and 8*b*, the smoking article 800 can be in the form of a cigar having a smoking material 802, a binder 804, and a wrapper 806. The smoking material 802 can be a blended material formed as a combination of cellulose material particles and tobacco material particles as shown and described in relation to FIGS. 2*a*-2*c*. The tobacco material particles can be formed from one of conventional tobacco material, modified tobacco material, or a combination thereof as desired. According to an exemplary embodiment of the present disclosure, the smoking material 802 can include a cellulose material consisting essentially of high purity cotton or cotton-based material or any other cellulosic material or cellulosic-derived material as has been described. The smoking material 802 can be impregnated with one or more additives (e.g., flavour, diluent, humectant, tobacco derivatives, etc.), as already discussed. The wrapper 806 can be formed of any known casing materials, such as a material consisting essentially of tobacco according to some embodiments. According to yet another exemplary embodiment, an additive insert can be inserted into the smoking material 802 of the cigar 800, such that when heated to at least a partially degraded state, the insert releases the additives into the smoking material 802.

FIGS. 9*a* and 9*b* illustrate a smoking article formed as a cigarillo in accordance with an exemplary embodiment of the present disclosure. As shown in FIGS. 9*a* and 9*b*, the smoking article can be formed as a cigarillo 900 and include a burn portion (e.g., smoking rod) 902 and a mouth portion 904. The burn portion 902 may be filled with a smoking material 906 formed as a blend of cellulose material particles and tobacco material particles as shown and described in relation to FIGS. 2*a*-2*c*. The tobacco material particles can be formed from one of conventional tobacco material, modified tobacco material, or a combination thereof as desired. The cellulose material particles can include high purity cotton or cotton-based material or any other cellulosic material. The smoking material 906 can be impregnated with one or more additives (e.g., flavour, diluent, humectant, tobacco derivatives, etc.), as already discussed. The burn portion 902 can be covered with an inner binder 908 and may also include an outer wrapper 910. The mouth portion 904 can include a filter plug 912 formed of cellulose acetate tow, use other filter designs as described above, or may include the same or similar materials as the burn portion 902. The mouth portion 904 may also include an interface 913, similar to other interfaces described herein. The filter plug 912 can be wrapped with plug paper 914. Tipping paper 916 may also be wrapped around the filter plug 912 on an outer surface of the plug paper 914. The tipping paper 916 can include suitable adhesive portions (not shown) at the seams so that when wrapped around the filter plug 912 the tipping paper overlaps on one end such that can securely attach the filter portion 904 to the burn portion 902. In certain embodiments, a space that may be established between adjacent ends of the filter plug 912 and the burn portion 902 to form an interface 913. The filter plug 912, interface 913 and/or the smoking material 906 may be impregnated with additives, such as a liquid or house one or more beads or capsules as described herein.

According to yet another exemplary embodiment of the present disclosure, a method of making smoking articles includes depositing a blended smoking material including a combination of cellulose material and tobacco material. The tobacco material can be formed from one of conventional tobacco material, modified tobacco material, or a combination thereof as desired. The cellulose material can consist of pure cotton or cotton-based material or any other cellulosic material. The cellulose material and tobacco material may be cut and/or shredded and deposited in a cigarette-making machine to form the smoking material blend. The blended material can be processed into any form and/or mixture included those illustrated in FIGS. 2*a*-2*c*. Further steps in the production of exemplary smoking articles as described herein include placing a paper wrapper around the blended material to form a burn portion (e.g., smoking rod). In certain embodiments, a filter portion may be attached to the burn portion, and in some embodiments a space may be formed between the two parts. The space may be empty or may be used as an interface within which additives can be stored and released during smoking. In other embodiments, a filter portion may be attached to the burn portion such that no space is formed between the two parts. An additive may also be added to the smoking material, which may, for example, consist of a liquid, bead, capsule, etc. The filter may be configured to have one more filter plugs, wherein the one or more filter plugs or a space between adjacent plugs may be filled with additives, such as flavor capsules, liquids, beads, etc. The filter may be configured to have other filter designs for smoking articles. Tipping paper may be wrapped around the mouth portion and may overlap the smoking rod. The tipping paper may be formed (e.g., processed) having a property or characteristic whereby an aroma or scent emanates from the tipping paper.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method of making a smoking article, comprising: forming a smoking rod filled with particles of tobacco filler material and particles of cellulose filler material free of tobacco, wherein the tobacco filler material at least partially surrounds the cellulose filler material along a length of the smoking rod and the cellulose filler material includes cut cellulose filter paper, shredded cellulose filter paper, or cut cellulose filter paper and shredded cellulose filter paper.

2. The method of making the smoking article of claim 1, wherein the tobacco filler material and the cellulose filler material are separately disposed in concentric areas along the length of the smoking rod.

3. The method of making the smoking article of claim 1, further comprising impregnating the cellulose filler material with an additive.

4. The method of making the smoking article of claim 1, further comprising impregnating the tobacco filler material or the cellulose filler material, or both, with an additive.

5. The method of making the smoking article of claim 3, wherein the additive comprises a flavorant.

6. The method of making the smoking article of claim 1, wherein the cellulose filler material is a part of a pre-formed rod.

7. The method of making the smoking article of claim 1, wherein the cellulose filler material further includes at least one material of the following materials: wood, jute, ramie, tree bark, banana leaves, bamboo, paper, cotton, and cotton-based material.

8. The method of making the smoking article of claim 1, wherein the cellulose filler material includes a cellulose material with an ash content that is less than or equal to 0.5% when burned.

9. The method of making the smoking article of claim 1, wherein the cellulose filler material includes a substantially acid-free or an unbleached cellulose material, or both.

10. The method of making the smoking article of claim 1, wherein the tobacco filler material includes a modified tobacco filler material.

11. The method of making the smoking article of claim 1, wherein the tobacco filler material includes a blend of conventional tobacco filler material and modified tobacco filler material.

12. The method of making the smoking article of claim 1, further comprising attaching a filter portion to the smoking rod.

13. The method of making the smoking article of claim 12, wherein the filter portion includes a multi-plug arrangement.

14. The method of making the smoking article of claim 13, wherein the filter portion includes an additive releasably stored in a bead or a capsule, or both.

15. The method of making the smoking article of claim 12, further comprising providing an interface between the filter portion and the smoking rod.

16. The method of making the smoking article of claim 1, further comprising providing an interface connected to the smoking rod opposite a burn end of the smoking rod.

17. The method of making the smoking article of claim 16, wherein the interface includes an additive.

18. The method of making the smoking article of claim 15, wherein the interface includes an additive.

19. The method of making the smoking article of claim 1, wherein a ratio of tobacco filler material to cellulose filler material is in a range of 95:5 to 25:75.

20. The method of making the smoking article of claim 1, wherein an amount of tobacco filler material in the smoking rod is less than an amount of cellulose filler material in the smoking rod.

21. The method of making the smoking article of claim 1, wherein the smoking article is a cigarette, a cigar, or a cigarillo.

22. A method of making a smoking article, comprising: forming a smoking rod filled with filler material including particles of tobacco filler material and particles of cellulose filler material free of tobacco, wherein at least some of the cellulose filler material is arranged in a higher temperature burn area of the smoking rod in relation to at least some of the tobacco filler material, and the cellulose filler material includes cut cellulose filter paper, shredded cellulose filter paper, or cut cellulose filter paper and shredded cellulose filter paper.

23. The method of making the smoking article of claim 22, wherein the tobacco filler material is arranged substantially along a periphery of an inner volume of the smoking rod.

24. The method of making the smoking article of claim 22, wherein the cellulose filler material is impregnated with an additive.

25. The method of making the smoking article of claim 22, wherein the cellulose filler material includes a cellulose material with an ash content that is less than or equal to 0.5% when burned.

26. The method of making the smoking article of claim 22, wherein the tobacco filler material and the cellulose filler material are separately disposed in concentric areas about a longitudinal axis of the smoking rod.

27. The method of making the smoking article of claim 22, wherein the tobacco filler material includes a modified tobacco material.

28. The method of making the smoking article of claim 22, wherein the cellulose filler material includes substantially acid-free or unbleached cellulose material, or both.

29. The method of making the smoking article of claim 22, further comprising attaching a filter portion to the smoking rod.

30. The method of making the smoking article of claim 29, wherein the filter portion includes an additive releasably stored in a bead or capsule, or both.

31. The method of making the smoking article of claim 29, further comprising providing an interface between the filter portion and the smoking rod.

32. The method of making the smoking article of claim 22, wherein the smoking rod is formed such that a portion of the smoking rod is not filled with the filler material, creating an interface configured to store an additive.

33. The method of making the smoking article of claim 31, wherein the interface includes an additive.

34. A method of making a smoking article, comprising attaching a filter portion to a smoking rod, the smoking rod including a blend of particles of tobacco filler material and particles of cellulose filler material free of tobacco, the blend containing a higher concentration of cellulose filler material than tobacco filler material in a central area along a length of the smoking rod, and the cellulose filler material includes cut cellulose filter paper, shredded cellulose filter paper, or cut cellulose filter paper and shredded cellulose filter paper.

35. The method of making the smoking article of claim 34, wherein the cellulose filler material is impregnated with an additive.

36. The method of making the smoking article of claim 35, wherein the additive includes a flavorant.

37. The method of making the smoking article of claim 34, wherein the filter portion includes a plug-space arrangement.

38. The method of making the smoking article of claim 34, wherein the filter portion includes an additive releasably stored in a bead or a capsule, or both.

39. The method of making the smoking article of claim 34, wherein a ratio of tobacco filler material to cellulose filler material is in a range of 95:5 to 25:75.

40. The method of making the smoking article of claim 34, wherein an amount of tobacco filler material is no more than half a total amount of filler material in the blend.

41. The method of making the smoking article of claim 34, further comprising providing an interface between the smoking rod and the filter portion.

42. The method of making the smoking article of claim 34, wherein the tobacco filler material includes conventional tobacco filler material, modified tobacco filler material, or both.

43. The method of making the smoking article of claim 41, wherein the interface includes an additive.

44. A method of making a smoking article, comprising forming a smoking rod including a filler comprising a mixture including particles of tobacco filler material and particles of cellulose filler material free of tobacco, wherein the tobacco filler material and cellulose filler material are distributed throughout the mixture along a length of the smoking rod, and the cellulose filler material includes cut cellulose filter paper, shredded cellulose filter paper, or cut cellulose filter paper and shredded cellulose filter paper.

45. The method of making the smoking article of claim 44, wherein the smoking rod is formed such that an interface is located in a portion of the smoking rod that is not filled with the filler.

46. The method of making the smoking article of claim 44, further comprising providing an interface in the smoking rod at an opposite a burn end of the smoking rod.

47. The method of making the smoking article of claim 44, further comprising attaching a filter portion to the smoking rod.

48. The method of making the smoking article of claim 47, further comprising providing an interface between the filter portion and the smoking rod.

49. The method of making the smoking article of claim 48, wherein the interface includes an additive.

50. The method of making the smoking article of claim 44, wherein the cellulose filler material includes an additive.

51. The method of making the smoking article of claim 44, wherein the tobacco filler material includes conventional tobacco filler material, modified tobacco filler material, or both.

52. A method of making a smoking article, comprising forming a smoking rod including a filler comprising a mixture including particles of modified tobacco filler material and particles of cellulose filler material free of tobacco, wherein the modified tobacco filler material and cellulose filler material are distributed throughout the mixture along a length of the smoking rod, and the cellulose filler material includes cut cellulose filter paper, shredded cellulose filter paper, or cut cellulose filter paper and shredded cellulose filter paper.

53. The method of making the smoking article according to claim 52, wherein the modified tobacco filler material and cellulose filler material are distributed throughout the mixture such that a higher concentration of cellulose filler material than tobacco filler material is disposed in a central area along a length of the smoking rod.

54. The method of making the smoking article according to claim 52, wherein the modified tobacco filler material and cellulose filler material are distributed throughout the mixture such that the modified tobacco filler material and cellulose filler material are randomly distributed throughout the mixture.

55. The method of making the smoking article according to claim 52, wherein the modified tobacco filler material and cellulose filler material are distributed throughout the mixture such that the modified tobacco filler material at least partially surrounds an area of the cellulose filler material.

56. The method of making the smoking article according to claim 52, wherein the modified tobacco filler material and the cellulose filler material are separately disposed in concentric areas along the length of the smoking rod.

57. The method of making the smoking article according to claim 52, wherein the cellulose filler material includes a cellulose material that includes at least one characteristic of the following characteristics: is acid-free, is unbleached, or has an ash content that is less than or equal to 0.5% when burned.

* * * * *